US005485249A

United States Patent [19]

Higeta et al.

[11] Patent Number: 5,485,249

[45] Date of Patent: Jan. 16, 1996

[54] PROCESS CARTRIDGE FRAME, PROCESS CARTRIDGE AND IMAGE FORMING APPARATUS

[75] Inventors: Akira Higeta, Funabashi; Kazuyoshi Odagawa, Koshigaya; Shinichi Sasaki, Fujisawa, all of Japan

[73] Assignee: Canon Kabushiki Kaisha, Tokyo, Japan

[21] Appl. No.: 298,152

[22] Filed: Aug. 30, 1994

[30] Foreign Application Priority Data

Aug. 31, 1993 [JP] Japan ..... 5-215654
Aug. 26, 1994 [JP] Japan ..... 5-201981

[51] Int. Cl.[6] ..... G03G 21/00

[52] U.S. Cl. ..... 355/210; 355/215; 355/245

[58] Field of Search ..... 355/200, 210, 355/215, 245, 296

[56] References Cited

U.S. PATENT DOCUMENTS 4,768,055 8/1988 Takamatsu et al. .
5,126,800 6/1992 Shishido et al. ..... 355/211
5,134,441 7/1992 Nagata et al. ..... 355/245
5,151,734 9/1992 Tsuda et al. ..... 355/200
5,208,634 5/1993 Ikemoto et al. ..... 355/215
5,223,893 6/1993 Ikemoto et al. ..... 355/200
5,294,960 3/1994 Nomura et al. ..... 355/210
5,331,373 7/1994 Nomura et al. ..... 355/200
5,345,294 9/1994 Nomura et al. ..... 355/200
5,404,198 4/1995 Noda et al. ..... 355/200

*Primary Examiner*—R. L. Moses
*Attorney, Agent, or Firm*—Fitzpatrick, Cella, Harper & Scinto

[57] ABSTRACT

A frame for a process cartridge, which is detachably mountable to an electrophotographic image forming apparatus and which comprises an electrophotographic photosensitive member and a process device or devices actable on the electrophotographic photosensitive member. The frame includes a base member having a mounting portion for mounting the process device or devices and an elastic sealing member for preventing leakage of a developer from the process cartridge when the process cartridge is assembled, wherein the base member and the elastic sealing member are integrally molded.

40 Claims, 13 Drawing Sheets

PROCESS CARTRIDGE FRAME, PROCESS CARTRIDGE AND IMAGE FORMING APPARATUS

FIELD OF THE INVENTION AND RELATED ART

The present invention relates to a frame of a process cartridge detachably mountable to a main assembly of an electrophotographic image forming apparatus, a process cartridge and an image forming apparatus.

The electrophotographic image forming apparatus includes an electrophotographic copying machine, a laser beam printer, a facsimile machine, a word processor and so on.

In an image forming apparatus such as a printer, a uniformly charged image bearing member is imagewisely exposed so that a latent image is formed. The latent image is visualized with toner into a toner image, which is transferred onto a recording material, thus effecting image recording. In such an apparatus, the toner is required to be replenished each time the toner is used up. The toner replenishing operation is not only is cumbersome but also may result in contamination. Maintenance of various parts requires an expert service man, thus imposing inconvenience on the user.

Therefore, the image bearing member, the charger, the developing device, the cleaning device and so on are unified into a process cartridge. By enabling the user to mount the cartridge to the main assembly of the apparatus, toner replenishment and exchange of parts can be carried out once their service lives are reached. By this, the maintenance operations are made easy. For such cartridges, further cost reduction and further quality improvement are desired.

From the standpoint of saving resources and energy and from the standpoint of reducing rubbish, recycling of the used cartridges, are considered.

For example, such parts as a charging member, developing member, a cleaning member or a frame containing them, may be still usable as the case may be even after the toner in the cartridge is used up. For this reason, the cartridges after use-up of the toner, are collected, and such parts are removed to reuse them.

In the process cartridge, as the sealing member for preventing leakage of the toner at the junction between frames, Moltopren (flexible polyurethane foam, available from Ionac, K.K.) or the like is bonded using an adhesive material, or a liquid elastomer is solidified, these materials being sandwiched between the frames.

However, the sealing material of the Moltopren or solidified liquid elastomer involves the following problems during the assembly of new cartridges and recycled cartridges.

In the manufacturing of the new cartridges, when the Moltopren is bonded on the frame, the operations are carried out manually with the result of difficulty in reducing cost, and with the result of variation of the quality in the bonding positions.

In order to accomplish automatic bonding of the Moltopren or in order to dispense the liquid elastomer to the frame, significant investment is required, and therefore, the cost is increased.

In the case of the recycling of the cartridge, the sealing member is kept compressed between the frames for a long period, and therefore, it is deformed such that the sealing material shape does not restore, even if the frames are separated. If the sealing member is reused as it is, the sealing property is not sufficient. When the Moltopren used as the sealing member, the toner enters the material to such an extent that the toner is not completely removed, even if it is cleaned.

Therefore, it would be considered that the sealing member of the Moltopren or elastomer is removed from the frames, and only the frames are recycled. In such a case, it is difficult to completely remove the doubled-sided adhesive for the Moltopren, and in addition it is time consuming to remove the elastomer.

It is expected that the sealing member may be an obstruction against cost reduction in the recycling of the cartridge.

SUMMARY OF THE INVENTION

Accordingly, it is a principal object of the present invention to provide a process cartridge frame, a process cartridge and an image forming apparatus in which number of assembling steps of the process cartridge is reduced to improve the assembling efficiency.

It is another object of the present invention to provide a process cartridge frame, a process cartridge and an image forming apparatus in which an accuracy of mounting position of a sealing member is improved, such that the quality of the process cartridge is improved.

It is a further object of the present invention to provide a process cartridge frame, a process cartridge and an image forming apparatus in which disassembling and reassembling operations are easy when the process cartridge is recycled.

It is a further object of the present invention to provide a process cartridge frame, a process cartridge and an image forming apparatus in which the number of assembling steps of the process cartridge is reduced to make the operations easier, and the disassembling and assembling operations are easy in the recycling operation.

It is a yet further object of the present invention to provide assembling or disassembling method, in which the operations relating to a sealing member is easy.

According to an aspect of the present invention, a sealing portion is formed in the sealing member, and therefore, frames constituting a developer container are coupled, the sealing member is closely contacted to the other member to function as a sealing member. Therefore, the necessity for the operation for bonding a separate sealing member is eliminated during the assembling operations of the process cartridge. Upon the disassembling of the process cartridge, the operation for removing the sealing member is not necessary.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the description will be made as to a frame of a process cartridge which is detachably mountable to an image forming apparatus, the process cartridge, and the image forming apparatus usable therewith, according to an embodiment of the present invention.

Embodiment 1

Figure 1:
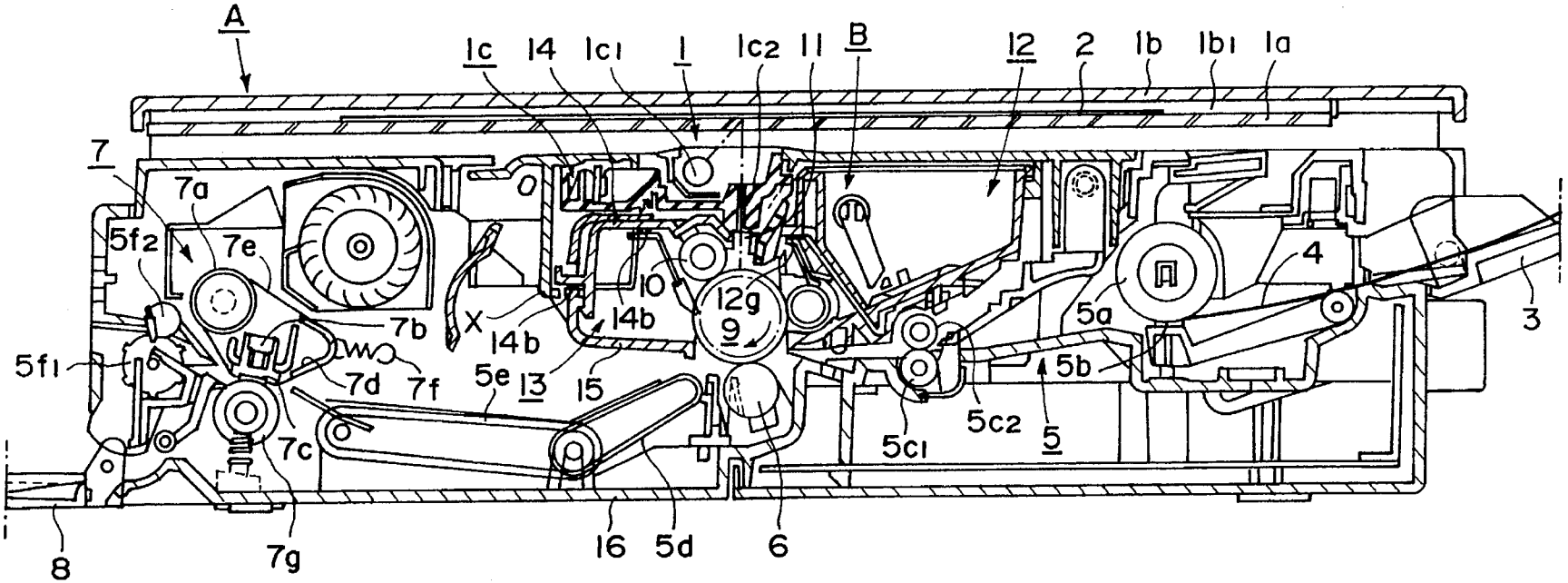
FIG. 1 is a schematic sectional view of an image forming apparatus to which a process cartridge according to an embodiment of the present invention is mounted.
Figure 2:
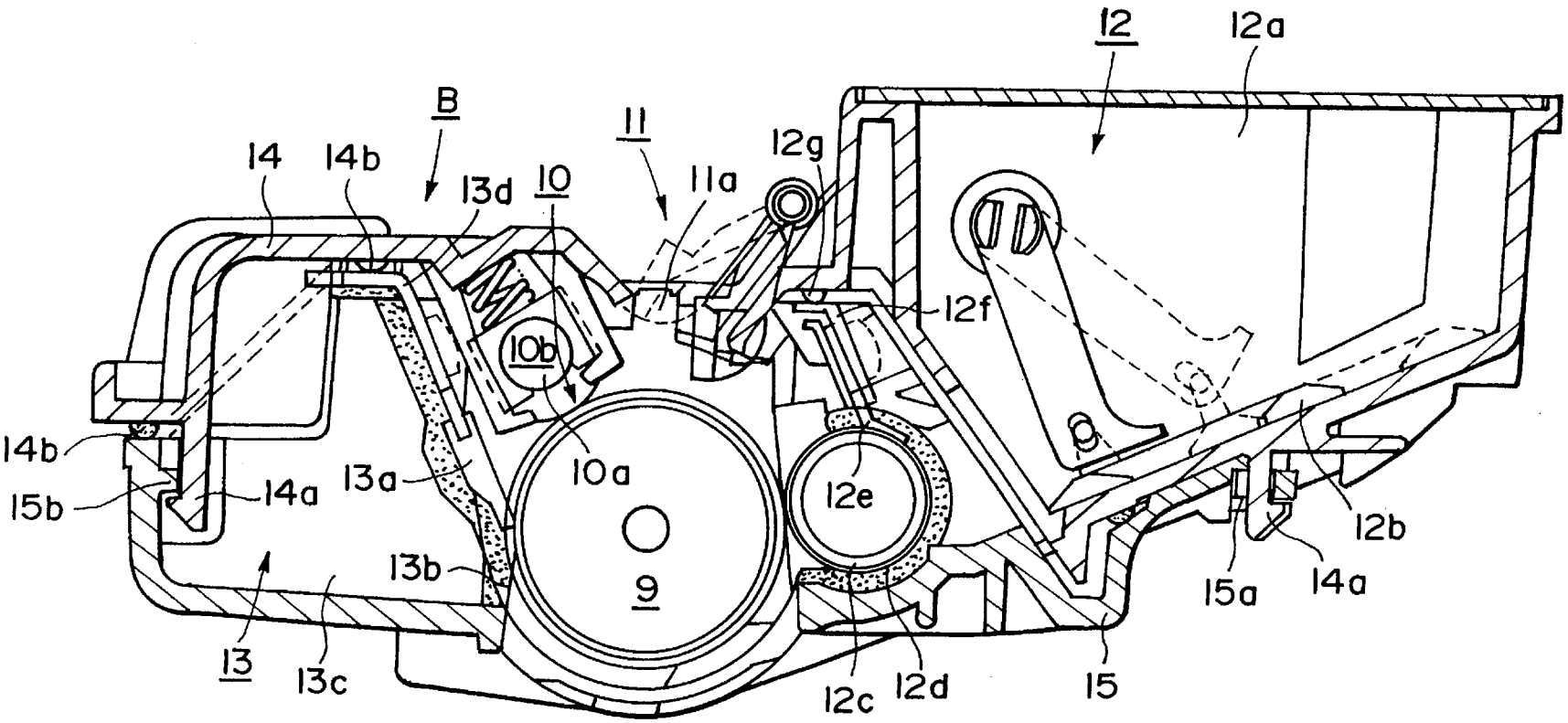
FIG. 2 is a schematic sectional view of a process cartridge.
Figure 3:
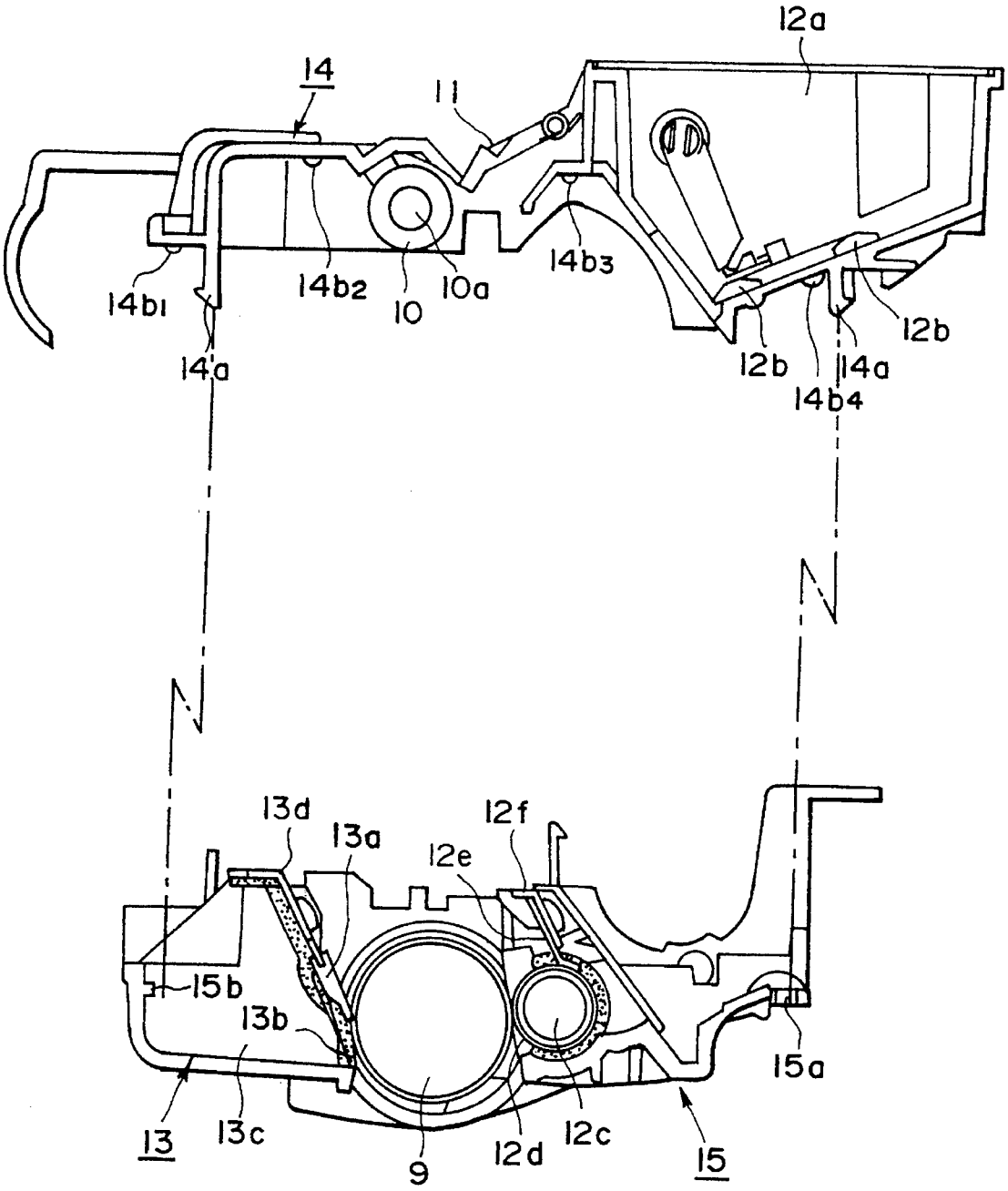
FIG. 3 is a sectional view in which it is separated into top and bottom frames.
Figure 11:
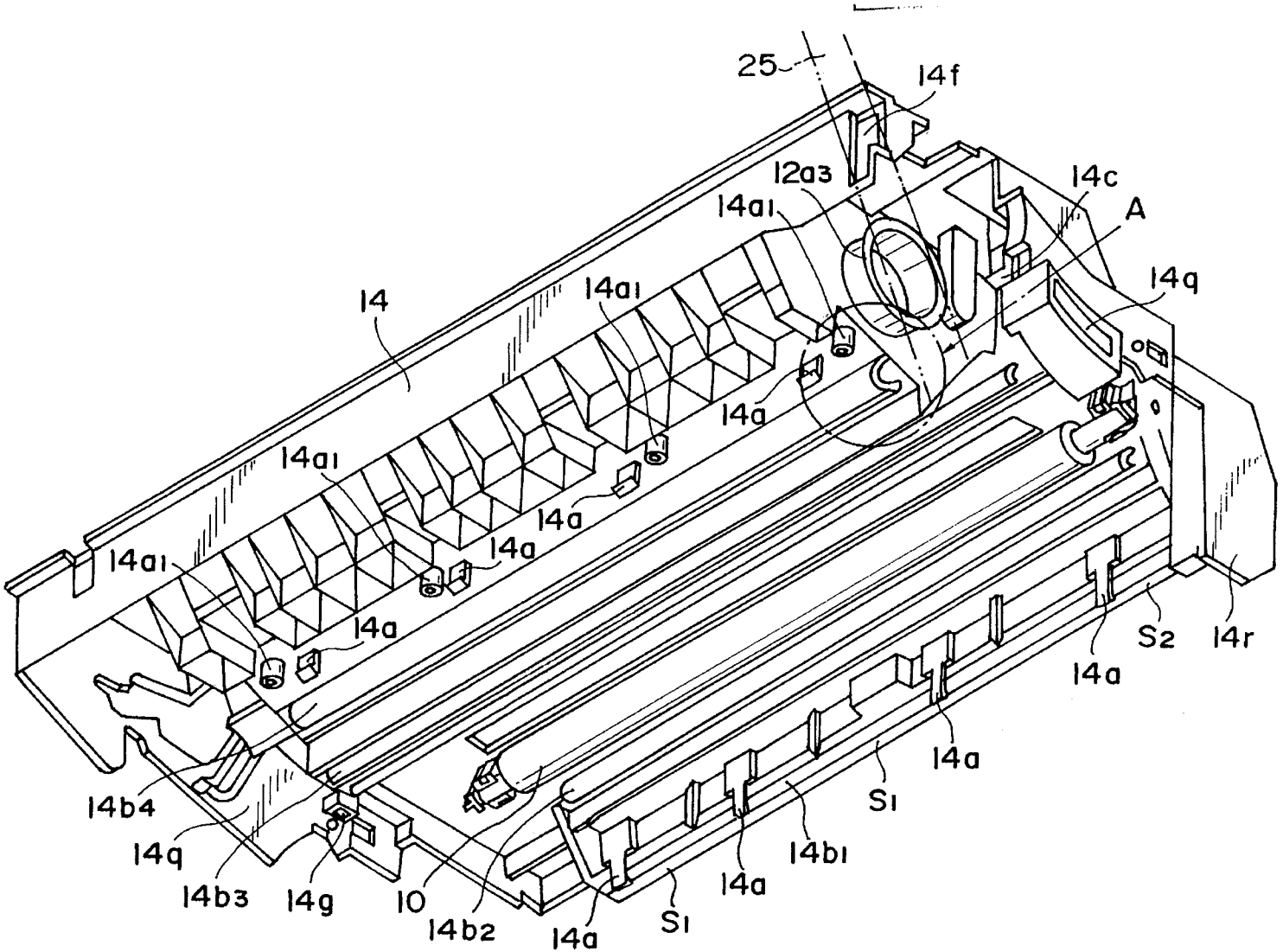
FIG. 11 is a perspective view of the top frame of FIG. 3.
Figure 12:
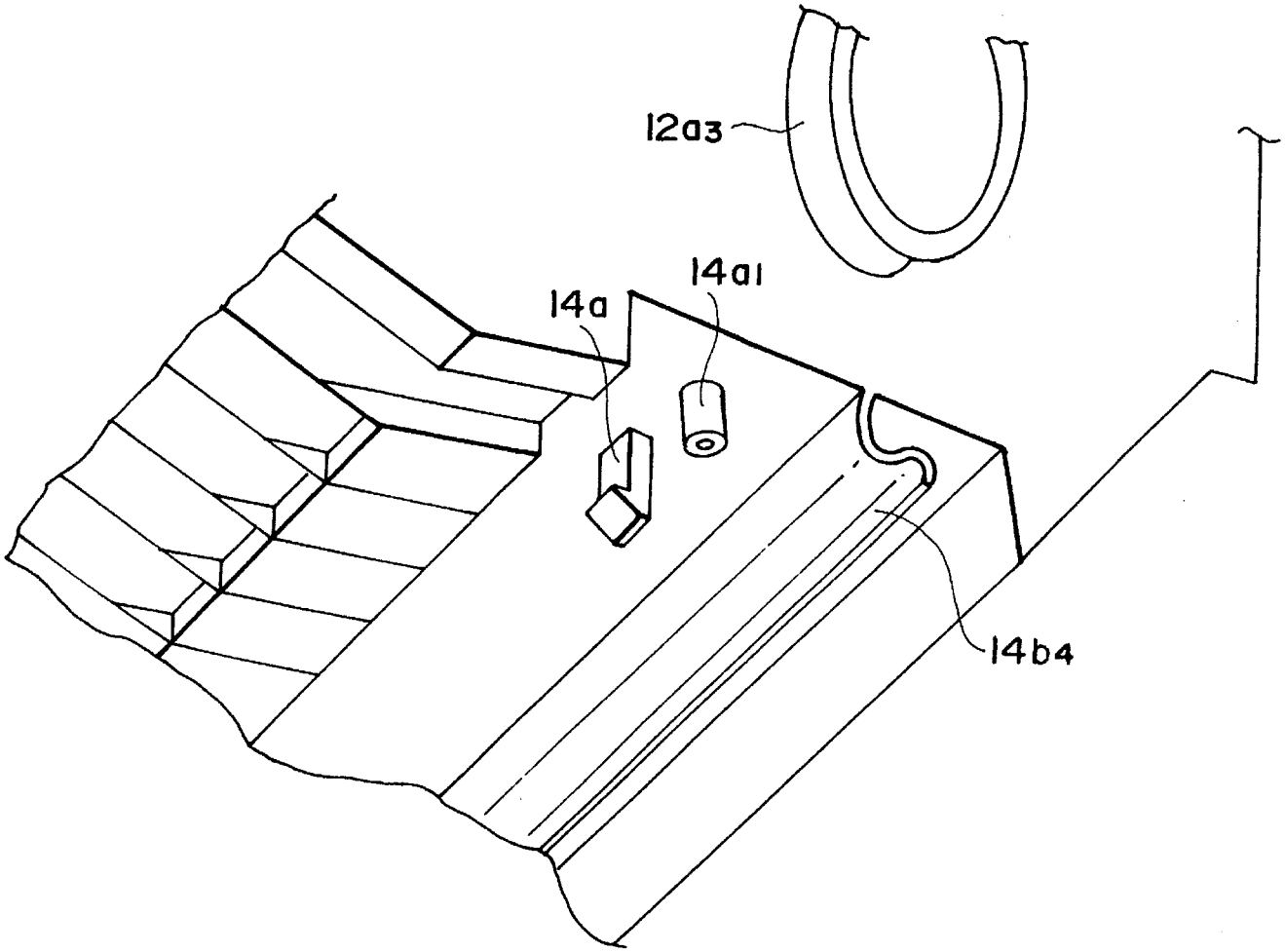
FIG. 12 is a perspective view of a portion A in FIG. 11.

Referring to FIG. 1, there is shown an image forming apparatus loaded with a process cartridge according to an embodiment of the present invention. FIG. 2 is a sectional view of the process cartridge. FIG. 3 is a sectional view in which the process cartridge is separated into top and bottom frames. FIG. 11 is a perspective view of the top frame of FIG. 3, and FIG. 12 is an enlarged perspective view of a portion A in FIG. 11.

The description will first be made as to the general arrangement of the apparatus, and then as to the process cartridge and the sealing structure of a developer container.

[General arrangement]

Referring to FIG. 1, an image forming apparatus A optically reads image information on an original 2 by an original reading means 1. A recording material 4 stacked on a sheet tray 3 or a recording material 4 manually fed from the tray 3 is transported by feeding means 5. In the image forming station which is in the form of a process cartridge B, a developed image is formed in accordance with the image information, and the toner image is transferred onto a recording material 4 by transfer means 6. The recording material 4 is fed to image fixing means 7, wherein the toner image is fixed on a recording material 4, and then the recording material 4 is discharged to a discharge tray.

In the process cartridge B constituting the image forming station, an image bearing member in the form of a photosensitive drum 9 is uniformly charged by charging means 10, and a light image read by the reading means 1 is projected onto the photosensitive drum 9 by exposure means 11, so that a latent image is formed on the photosensitive drum 9. The latent image is visualized into a toner image by developing means 12. After the toner image is transferred onto the recording material 4 by the transfer means 6, the residual toner on the photosensitive drum 9 is removed by cleaning means 13.

The process cartridge B is in the form of a cartridge including the photosensitive drum 9 or the like and a frame for covering them. The frame is constituted by a first frame (top frame) 14 and a second frame (bottom frame) 15.

[Image forming apparatus]

As to the image forming apparatus A, the original reading means, the recording material feeding means, the transfer means and the fixing means will be described in this order.

[Original reading means]

The original reading means 1 optically reads the information on the original 2. As shown in FIG. 1, an original supporting glass 1*a* for supporting the original 2 on the top of the main assembly 16, an original confining plate 1*b* having a sponge 1*b*1 mounted to the bottom surface thereof is openable from the top of the original supporting platen glass 1*a*. The platen glass 1*a* and the confining plate 1*b*1 are slidable relative to the main assembly 16 in the horizontal direction in FIG. 1.

Below the platen glass 1*a* in the upper position is the main assembly 16, a lens unit 1*c* is provided including an illumination source 1*c*1 and a short focus imaging lens array 1*c*2.

The original 2 is placed face down on the platen glass 1*a*, and the illumination source 1*c*1 is turned on. The platen glass 1*a* is moved in the horizontal direction in FIG. 1, and the light reflected by the original surface is projected onto the photosensitive drum 9 in the process cartridge B through the lens array 1*c*2.

[Recording material feeding means]

The feeding means 5 function to feed the recording material from the feed tray 3 into the image forming station, and further feeds it to the fixing means 7 and further to the discharge tray 8. A plurality of recording materials 4 are stacked on the tray 3, or one recording material 4 is manually fed by the feeding tray 3, by which a leading edge of the recording material 4 is fed to a nip formed by a feeding roller 5*a* and a friction pad 5*b* press-contacted thereto. When the copy button (not shown) is depressed, the feeding roller 5*a* rotates to separate and feed the recording material 4, and a pair of registration rollers 5*c*1 and 5*c*2 feed the recording material in synchronism with the image forming operation. After the image formation on the recording material, the recording material is fed to the fixing means 7 by the feeding belt 5*d* along the guiding member 5*e*. Then, it is discharged to a discharge tray 8 by discharging rollers 5*f*1 and 5*f*2.

[Transfer means]

The transfer means 6 functions to transfer the toner image onto the recording material 4 formed on the photosensitive drum 9. As shown in FIG. 1, the transfer means 6 of this embodiment includes a transfer roller 6. The recording material 4 is press-contacted to the photosensitive drum 9 of the process cartridge B mounted to a mount X in the main assembly of the image forming apparatus. The transfer roller 6 is supplied with a voltage having the polarity opposite from that of the toner image formed on the photosensitive drum 9, by which the toner image is transferred from the photosensitive drum 9 onto the recording material 2.

[Fixing means]

The fixing means 7 functions to fix onto the recording material 4 the toner image having been transferred onto the recording material 4 by the application of the voltage to the transfer roller 6. As shown in FIG. 1, a heat resistive fixing film 7*e* is trained around a driving roller 7*a*, a heater 7*c* supported on a holder 7*b* and a tension plate 7*d*. The tension plate 7*d* is urged by a tension spring 7*f* to apply tension to the fixing film 7*e*, to the fixing film 7*e*, a pressing roller 7*g* is press-contacted adjacent the heater 7*c*, so that the fixing film 7*e* is press-contacted to the heater 7*c* with the force required for the image fixing operation.

The heater 7*c* is heat resistive material such as alumina or the like. A linear or planar heating surface of $Ta_2N$ or the like is formed on the bottom surface of the holder 7*b* comprising an electrically insulative material. The surface thereof is covered with $Ta_2O$ as a sliding and projection layer. The bottom surface of the heater 7*c* is smoothly flat, and the front and rear edges thereof are rounded to permit smooth sliding relative to the fixing film 7*e*. The fixing film 7*e* comprises as a base material polyester resin material treated for heat resistance, and is rotated in the clockwise direction in FIG. 1 by rotation of the driving roller 7*a*.

When the recording material having the transferred toner image passes through the nip formed between the fixing film 7*e* and the pressing roller 7*g*, the heat and pressure are applied by which the toner image is fixed on the recording material 4.

[Process cartridge]

Various parts of the process cartridge B detachably mountable to the image forming apparatus A, will be described in detail.

The process cartridge B contains an image bearing member and at least one process means. The process means includes, for example, charging means for charging the surface of the image bearing member, developing means for forming a toner image on the image bearing member, cleaning means for removing residual toner on the surface of the image bearing member. In the process cartridge B of this embodiment, as shown in FIGS. 1 and 2 around the electrophotographic photosensitive member as the image bearing member are disposed the charging means 10, the developing means 12 and the cleaning means 13. They are covered with a housing comprising top and bottom frames 14 and 15, into a unified cartridge. The cartridge is detachably mountable to the main assembly 16 of the image forming apparatus.

The structures of the various parts of the process cartridge B will be described in the order of the photosensitive drum 9, the charging means 10, the exposure means 11, the developing means 12, the cleaning means 13 and the top and bottom frames 14 and 15.

[Photosensitive drum]

The photosensitive drum 9 comprises a drum base of cylindrical aluminum and organic photoconductive layer applied on the outer peripheral surface thereof. The photosensitive drum 9 is rotatably supported on the frame. It comprises a flange gear (helical gear) fixed to one longitudinal end thereof. The gear is brought into meshing engagement with a gear in the main assembly so that driving force can be transmitted from the driving motor, to rotate the photosensitive drum in the direction indicated by an arrow in FIG. 1, in accordance with the image forming operation.

[Charging means]

The charging means functions to uniformly charge the surface of the photosensitive drum 9. In this embodiment, the charging roller 10 is rotatably mounted on the frame, and is a contact type charging member. It comprises a roller shaft 10*a* of metal and an elastic layer of electrical conductivity thereon. A high resistance elastic layer is further provided thereon, and a surface protection layer is provided further thereon. The elastic layer of the electrical conductivity is a carbon dispersed elastic rubber layer of EPDM or NBR or the like, and therefore, the bias voltage supplied to the roller shaft 10*a* is conducted. The high resistance elastic layer is of urethane rubber or the like and comprises a small amount of fine electroconductive powder, for example. The high resistance layer is effective to prevent large voltage drop of the bias voltage by limiting leakage current to the photosensitive drum 9, even if a high electroconductive portion of the photosensitive drum 9 provided by pin hole or the like, is contacted to the charging roller. The protection layer comprises N-methylmethoxynylon, by which the plastic material of the conductive elastic layer or the high resistance elastic layer is prevented from deteriorating the surface of the photosensitive drum 9 by the contact thereof to the surface of the photosensitive drum 9.

The charging roller 10 is contacted to the photosensitive drum, and during the image forming operation, the charging roller 10 is rotated by the rotation of the photosensitive drum 9. During the operation, the charging roller 10 is supplied with an AC biased DC voltage, by which the surface of the photosensitive drum 9 is uniformly charged.

[Exposure station]

The exposure station 11 functions to project the light image reflected by the surface of the original 2 after being emitted from the illumination source 1*c*1, onto the surface of the photosensitive drum 9 having been uniformly charged by the charging roller 10, through the lens 1*c*2. By the projection of the light image, an electrostatic latent image is formed on the surface of the drum 9. The exposure station includes an opening 11*a*, formed in the top surface of the cartridge frame 14, to permit the introduction of the light image.

[Developing means]

The developing means 12 includes a toner container, in the upper frame 14 as shown in FIG. 2, for containing the toner. A toner feeding member 12*b* for feeding the contained toner out is reciprocally mounted. The top frame 14 is provided with an opening, in which a developing sleeve 12*d* is mounted with a small gap with the photosensitive drum 9, the developing sleeve 12*d* including non-rotatable magnet 12*c* therein and effective to form a thin toner layer thereon by rotation thereof.

The surface of the aluminum cylindrical member of the developing roller 12 is roughened by sand-blasting, and the surface is coated with electroconductive paint in which pigments are dispersed. When the toner layer is formed on the surface of such a developing roller 12*d*, sufficient triboelectric charge for developing the latent image on the photosensitive drum 7 is provided by rubbing between the developing sleeve 12*d* and the toner. In order to regulate the layer thickness of the toner, a developer blade 12*e* is provided, which is supported by a blade holder 12*f*. The holder 12*f* fixed to the bottom frame 15 by screws.

[Cleaning means]

As shown in FIG. 2, the cleaning means 13 comprises an elastic cleaning blade 13 for scraping off the residual toner on the drum 9 by contacting the surface of the photosensitive drum 9, and a receptor sheet 13*b*, disposed below the blade 13*a*, for receiving the toner scraped off by the cleaning blade 13, the receptor sheet 13*b* is lightly contacted to the surface of the photosensitive drum 9. The cleaning means further comprises a residual toner container 13*c* for containing the received residual toner.

Similarly to the developing blade 12*e*, the cleaning blade 13*a* is held on a blade holder 13*d*, and the holder 13*d* is fixed on the bottom frame 15 by screws.

[Frames]

The housing of the process cartridge B is constituted by a top frame 14 and a bottom frame 15, coupled together with each other, as shown in FIGS. 2 and 3. The top frame 14 comprises the charging roller 10, the toner container 12*a* constituting the developing means and a toner feeding member 12*b*, and the bottom frame 15 comprises the photosensitive drum 9, the developing sleeve 12*d* constituting the developing means, the developing blade 12*e* and the cleaning means 13.

In order to couple the top and bottom frames 14 and 15, the top frame 14 has integral claws 14*a* at regular intervals in the longitudinal direction. The bottom frame 15 has integral projections 15*b* and openings 15*a* for engagement with the claws 14*a*. Therefore, the top and bottom frames 14 and 15 are coupled, and the claws 14*a* are engaged with the openings 15*a* and the protections 15*b*, elastically, so that the top and bottom frames 14 and 15 are coupled to constitute the housing.

[Sealing structure for toner containing portion]

Figure 4:
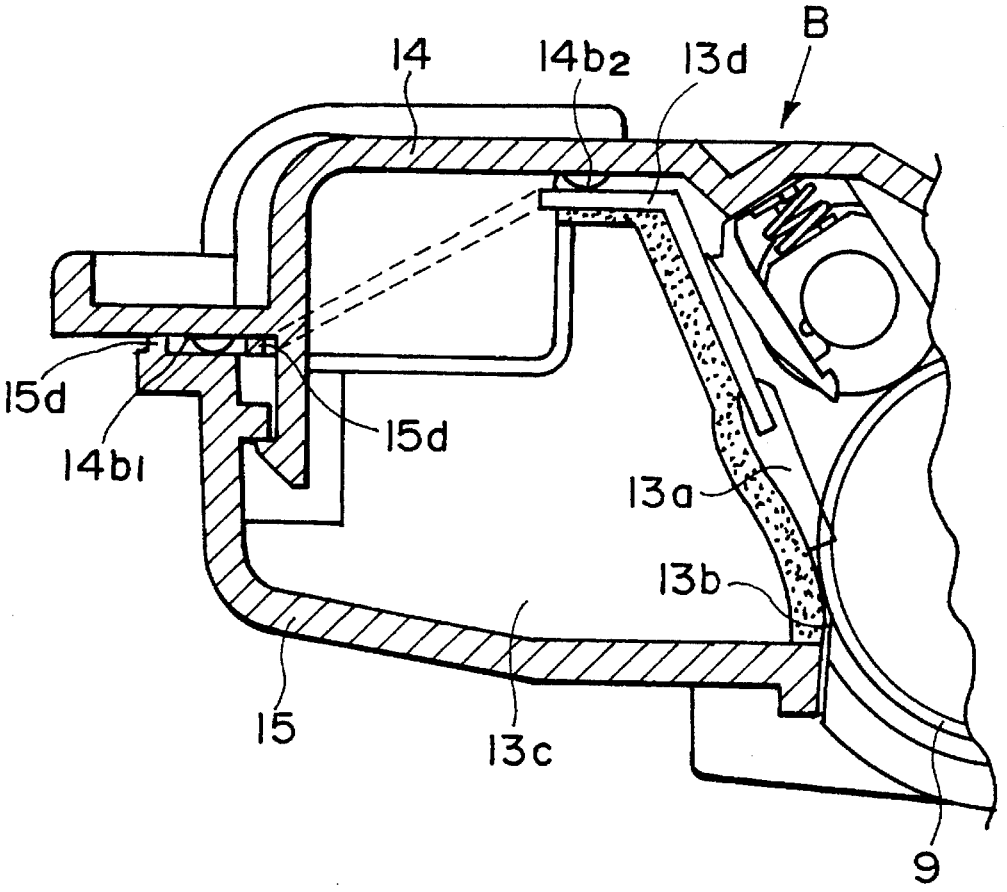
FIG. 4 illustrates a residual toner container for cleaning means.
Figure 5:
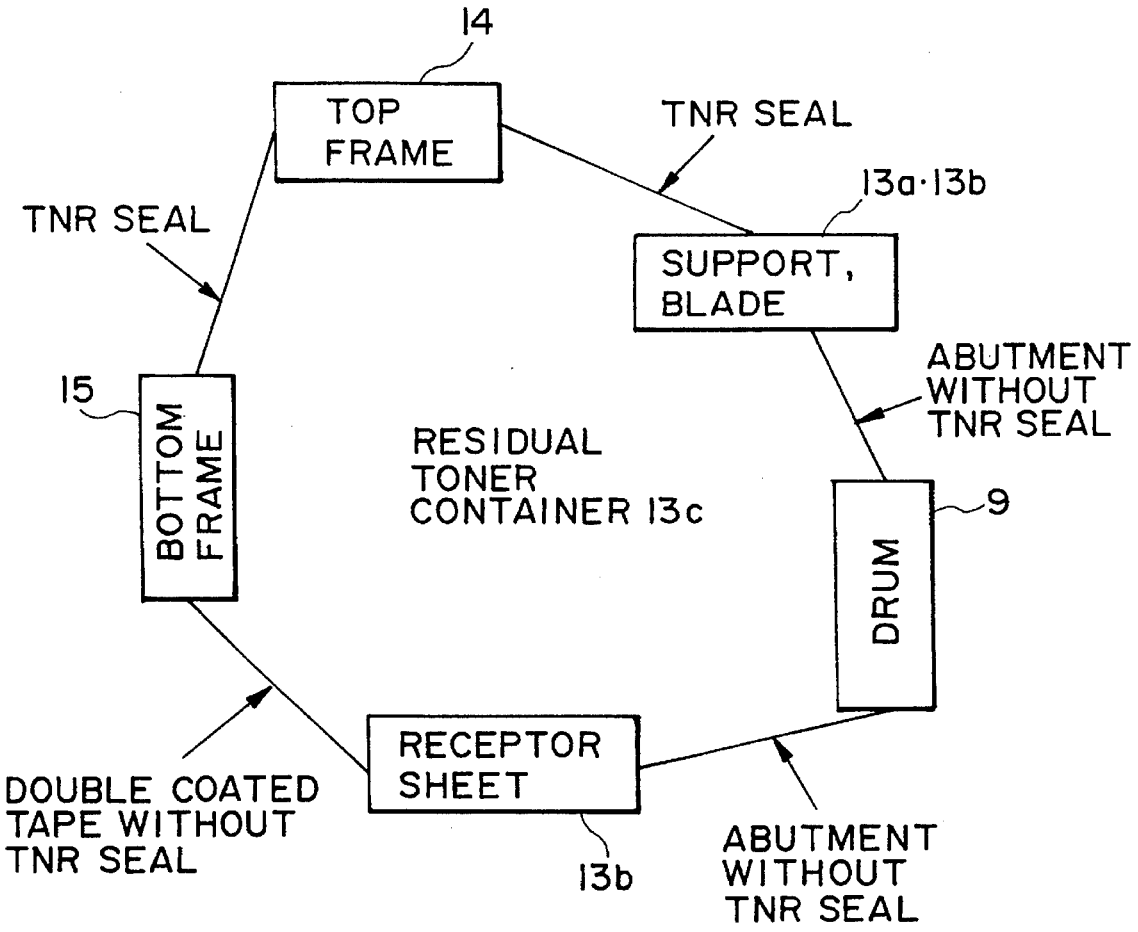
FIG. 5 schematically illustrates coupling between various members constituting the residual toner container.
Figure 6A:
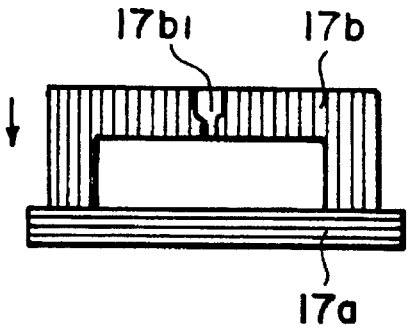
FIG. 6 includes FIGS. 6(*a*) through 6(*f*) and illustrates two-color molding.
Figure 6B:
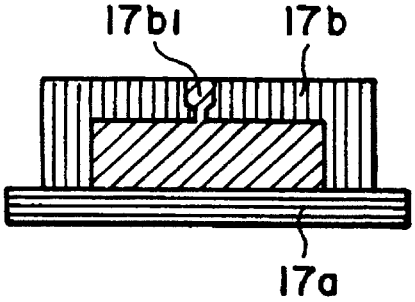
Figure 6C:
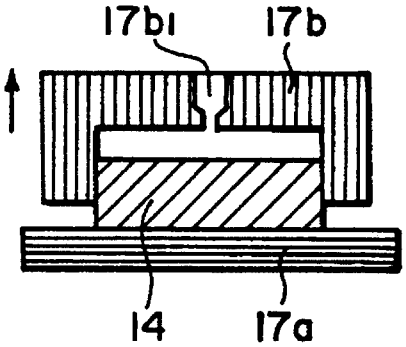
Figure 6D:
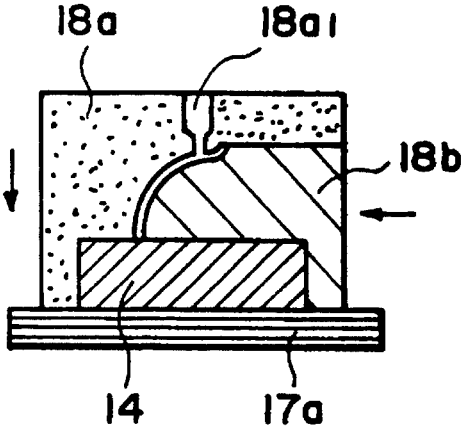
Figure 6E:
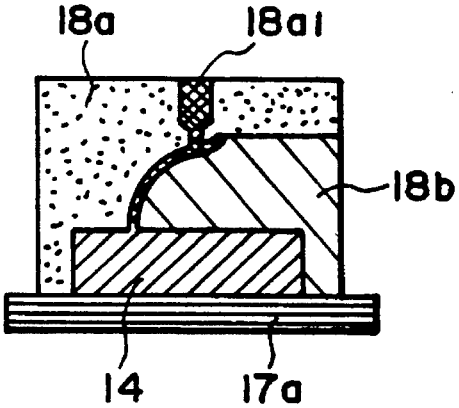
Figure 6F:
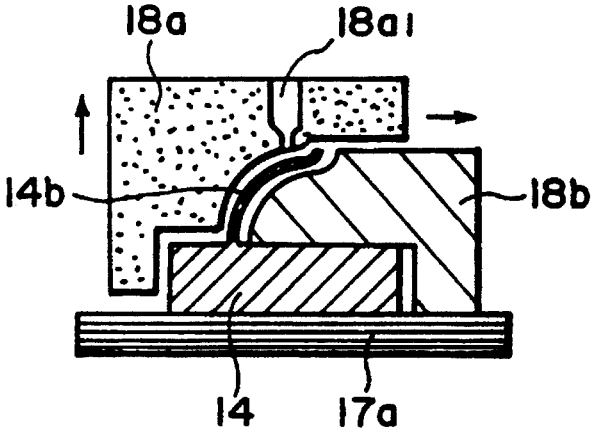
Figure 7A:
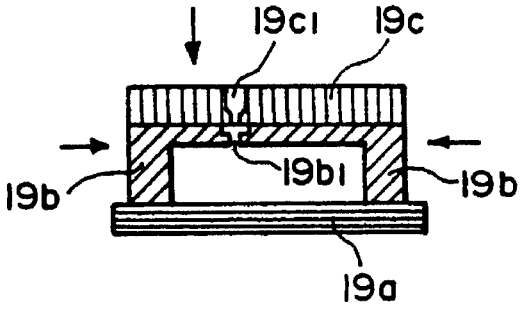
FIG. 7 includes FIGS. 7(*a*) through 7(*f*) and illustrates two-color molding in the case where the materials of the frame and the sealing member are not compatible.
Figure 7B:
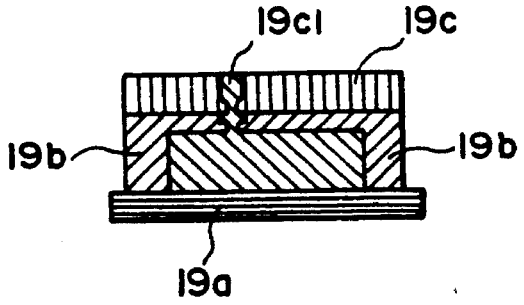
Figure 7C:
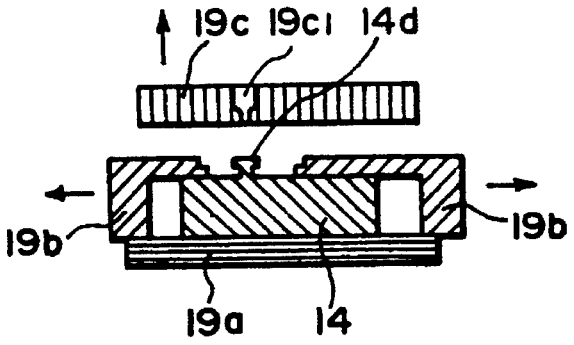
Figure 7D:
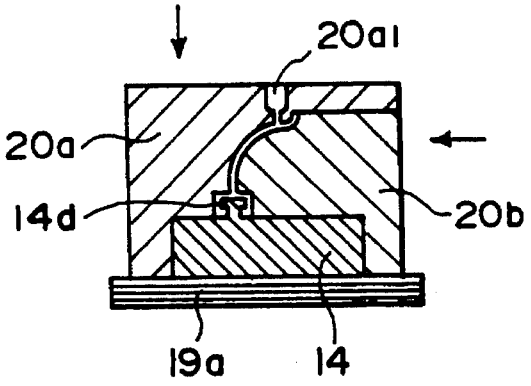
Figure 7E:
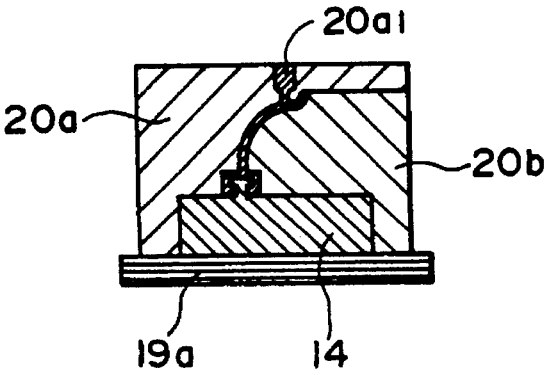
Figure 7F:
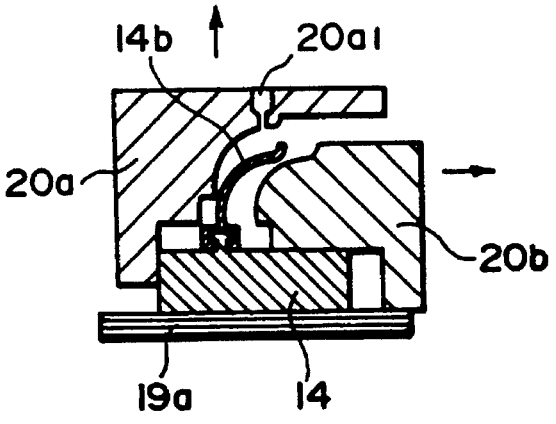

The sealing structure for the toner containing portion will be described with respect to a residual toner container 13*c* of the cleaning means 13, as an example. The residual toner container 13*c* is constituted by coupling the top and bottom frames 14 and 15. As shown in FIGS. 4 and 5, the residual toner container 13*c* is constituted by the top frame 14, the blade holder 13*d*, the cleaning blade 13*a*, the photosensitive drum 9, the receptor sheet 13*b*, the bottom frame 15 and the top frame 14, which together constitute a closed space. In order to prevent fine toner particles from leaking, sealing is effected among them. Among the portions between adjacent members in the longitudinal direction of the photosensitive drum 9, the toner does not leak between the cleaning blade 13 and the photosensitive drum 9, and between the photosensitive drum 9 and the receptor sheet 13*b*, because the blade 13*a* and the receptor sheet 13*b* are contacted to the photosensitive drum 9. Therefore, any particular sealing is not required between them. Between the receptor sheet 13*b* and the bottom frame 15, the receptor sheet 13*b* is directly adhered to the bottom frame 15 by double-sided tape or the like, and therefore, the toner leakage does not occur, and no particular sealing is required between them.

Between the bottom frame 15 and the top frame 14 and between the top frame 14 and the blade holder 13*d*, it is difficult to completely seal between the members, and therefore, there is a liability of the toner leakage, thus necessitating the sealing. In this embodiment, as shown in FIG. 4, elastic sealing members 14*b*1 and 14*b*2 are integrally formed with the top frame 14, and the seals 14*b*1 and 14*b*2 are closely contacted to the bottom frame 15 and the blade holder 13*d*, so that the sealing structure is established. That is, the seal 14*b*1 is closely contacted to the bottom frame 15, and the seal 14*b*2 is closely contacted to the holder 13*d*, by which the toner leakage from the cartridge is prevented. As shown in FIG. 4, sealing members 17 are mounted to the blade 13*a* and blade holder 13*d* at opposite longitudinal ends.

As for the toner containing portion for containing the developer to be supplied to the developing roller 12*d*, the toner leakage prevention adjacent the developing roller 12*d* is established by seals 14*b*3 and 14*b*4. More particularly, when the top and bottom frames 14 and 15 are coupled, the seals 14*b* are elastically contacted to the blade holder 12*f* mounted on the bottom frame 15, and the seal 14*b*4 is elastically contacted to the bottom frame 15. By doing so, the toner leakage between the top and bottom frames 14 and 15 of the process cartridge is effectively prevented.

In this embodiment, the seals 14*b*1–14*b*4 are integrally formed with the top frame 14 through two-color molding. Here, the two-color molding is not limited to the molding using same materials with different colors, but also includes the integral molding of different materials. In other words, the two-color molding includes injection molding of subsequently injecting into a metal mold the same material with different colors in a sequential fashion, but also includes wherein molding injecting different materials are injected.

Referring to FIG. 6, the description will be made as to the formation of the seals 14*b*1–14*b*4 through the two-color molding. Metal molds 17*a* and 17*b* for the frame are closed (FIG. 6, (*a*)). A plastic material for the frame 14 which has a sufficient rigidity as the frame, such as HIPS (high impact styrole resin material), PPO (polyphenylene oxide) or the like, is injected through an injection hole 17*b*1 (FIG. 6, (*b*)). After the solidification of the resin material, the metal mold 17*b* is opened (FIG. 6, (*c*)). By this, the top frame 14 is formed without the seal 14*b*.

Subsequently, sealing metal molds 18*a* and 18*b* are closed on the top frame 14 (FIG. 6, (*d*)). Through an injection hole 18*a*1, a material is injected (FIG. 6, (*e*)), the material being for the seal and being, for example, an elastomer such as polyurethane elastomer, polystyrene elastomer or the like compatible with the HIPS, PPO or the like. These materials have such an elasticity as to be manually deformable. After the material is solidified, the metal molds 18*a* and 18*b* are opened (FIG. 6, (*f*)). By this, the sealing member 14*b* having elasticity is integrally formed with the main body of the top frame. Here, since the resin materials are different, the frame and the seals have different colors.

When the seal 14*b* is formed with polyamide elastomer, polyester elastomer and polyolefine elastomer or the like which is not compatible with the HIPS, PPO or the like, the injection molding is preferably as shown in FIG. 7, in which the injection steps are quite similar to that shown in FIG. 6. However, in order to integrally form a projection 14*d* having a "T" cross-section on the top frame 14, the metal molds 19*b* of the metal molds 19*a*, 19*b* and 19*c* for forming the frame, is provided with a recess 19*b*1 having the "T" cross-section. Using the metal molds 19*a*, 19*b* and 19*c*, the injection molding is effected in the same manner with FIG. 6, so that a frame 14 having the "T" projection 18*d* is integrally molded (FIG. 7, (*a*)–(*c*)).

Subsequently, metal molds 20*a* and 20*b* for formation of the seal is used, and the seal material is injected so as to enclose the "T" projection 14*d*. The material is the above-described polyamide elastomer, polyester elastomer, polyolefine elastomer, or the like. Thus, the seal 14*b* and the "T" projection 14*d* are made mechanically integral. Thus, the frame 14 and the sealing member 14*b* are integrally formed.

As another material for the seal there is silicone rubber, soft rubber or the like. When these materials are used, the proper one of the above-described methods is selected depending on the compatibility with the HIPS or PPO or the like.

By doing so, even if the material of the frame 14 and the material of the seal 14*b* are not compatible, the integration is easily possible by the injection molding. Designated by reference numerals 19*c*1 and 20*a*1 are injection holes.

In place of the two-color molding, an outsert molding is possible in which use is made of a plurality of independent molds, and the frame with the seal is formed.

Figure 8A:
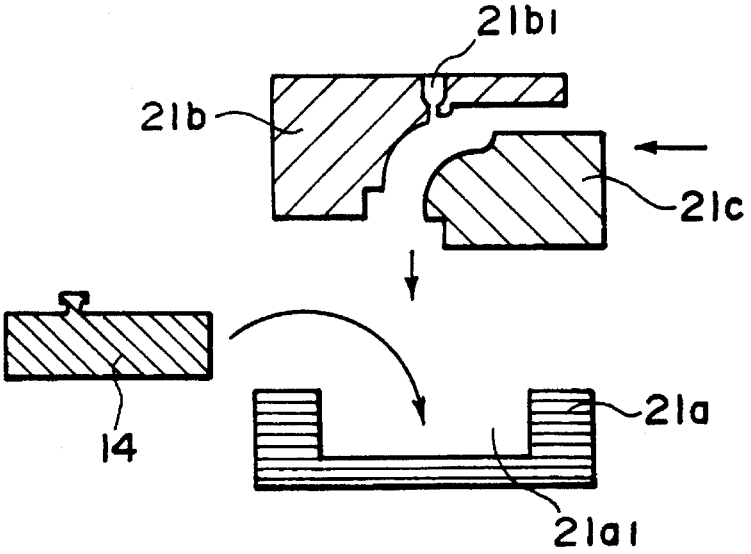
FIG. 8 includes FIGS. 8(*a*) through 8(*c*) and illustrates outsert molding.
Figure 8B:
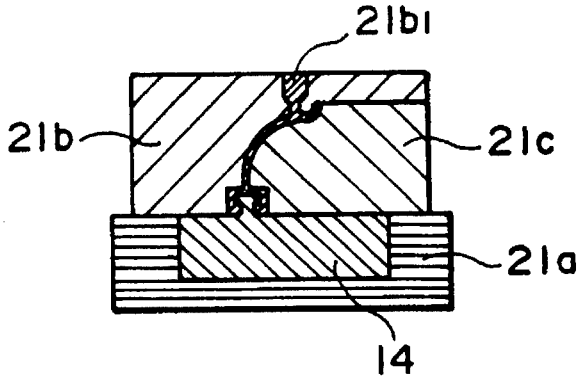
Figure 8C:
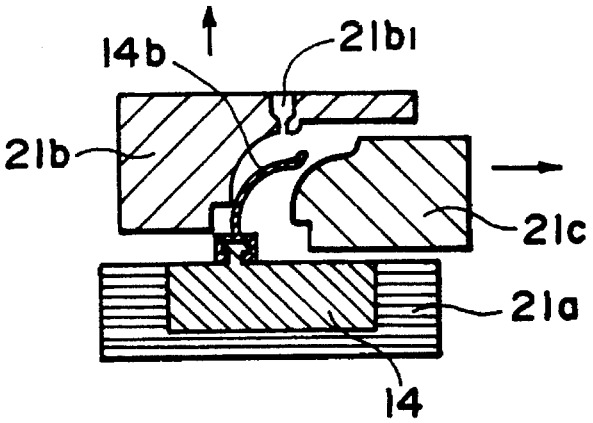

For example, as shown in FIG. 8, (*a*), the frame 14 already formed by metal molds, is engaged in a core of a metal mold 21*a* of the independent molds including the metal molds 21*a*, 21*b* and 21*c*, and as shown in FIG. 8, (*b*), the molds are closed. The material for the seal is injected and molded in a similar manner. Thereafter, as shown in FIG. 8, (*c*), the molds are opened. Thus, the integral molding is possible similarly to the two-color molding. Even in the case of this outsert molding, the integral molding is possible irrespective of the compatibility of the materials.

Designated by reference numeral **21*b*1** is an injection hole for the resin material.

In any case, as shown in FIGS. 11 and 12, the seals **14*b*1–14*b*4 are integrally molded with the top frame 14** in the form of a tongue extending along the longitudinal direction of the cartridge.

Figure 9A:
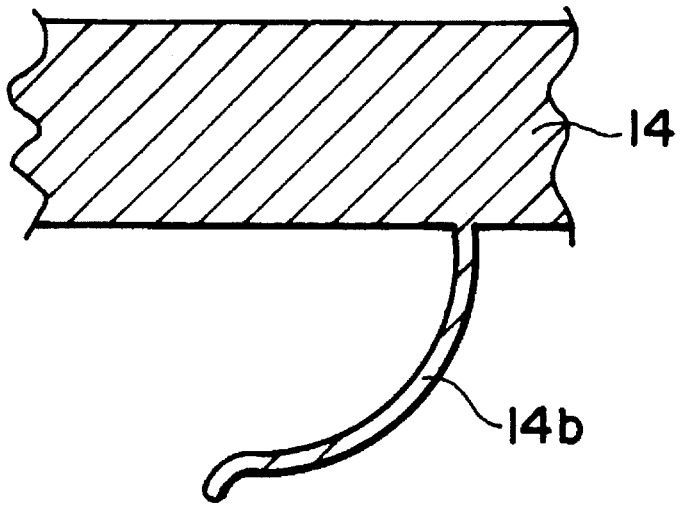
FIG. 9 includes FIGS. 9(*a*) and 9(*b*) and illustrates a sealing member integral with the top frame, and the sealed state using the sealing member.
Figure 9B:
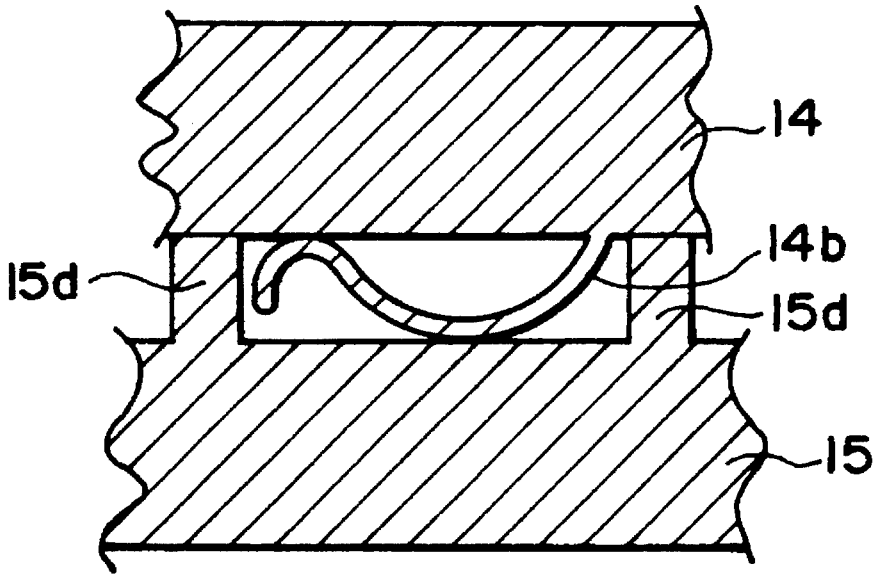

When the bottom frame 15 is coupled with the top frame 14 having the curved sealing member **14*b* formed by the two-color molding or the like, as shown in FIG. 9**, (*a*), the seal **14*b* (14*b*1–14*b*4) are deformed in contact with the bottom frame 15 or the blade holder 13*d*, as shown in FIGS. 4 and 9**(*b*), by the reaction forces, the seal **14*b* is press-contacted to the bottom frame 15 or the blade holder 13*d* to establish hermetical sealing. The degree of the deformation of the seal 14*b* is regulated by an abutment 15*d* of the bottom frame 15**.

In these embodiments, the elastic force of the seal **14*b* is such that when the frame having the integral seal 14*b* is coupled with the other member, the seal 14*b*** is elastically deformed to establish the sealing against the toner leakage. The thickness, configuration, and the material of the seal can be properly determined by one skilled in the art to satisfy this.

As described in the foregoing, by the provision of the seal or seals **14*b* integral with the top frame 14, the bonding step for the sealing member or the sealing material injection step are eliminated in the coupling of the top and bottom frames 14 and 15**, and therefore, the number of assembling steps can be reduced. This saves the manufacturing costs to such an extent that the cost reduction is sufficiently larger than the cost increase due to the apparatus and the metal molds required for the two color molding or the like.

When the sealing is effected by injecting the liquid elastomer as in the prior art, the cross-section of the seal is limited to be semicircular. However, according to the above embodiments, the cross-section of the seal **14*b* selected from wide range such that the configuration is most suitable for the sealing. Therefore, the degree of the deformation and the reaction of the seal 14** can be optimized.

In the case of the recycling of the cartridge B, the top and bottom frames 14 and 15 are separated from each other, and they are cleaned by blowing air or the like. In this case, there is no need of replacing the seals **14*b***, and the reassembling operations are easier.

Embodiment 2

Figure 10A:
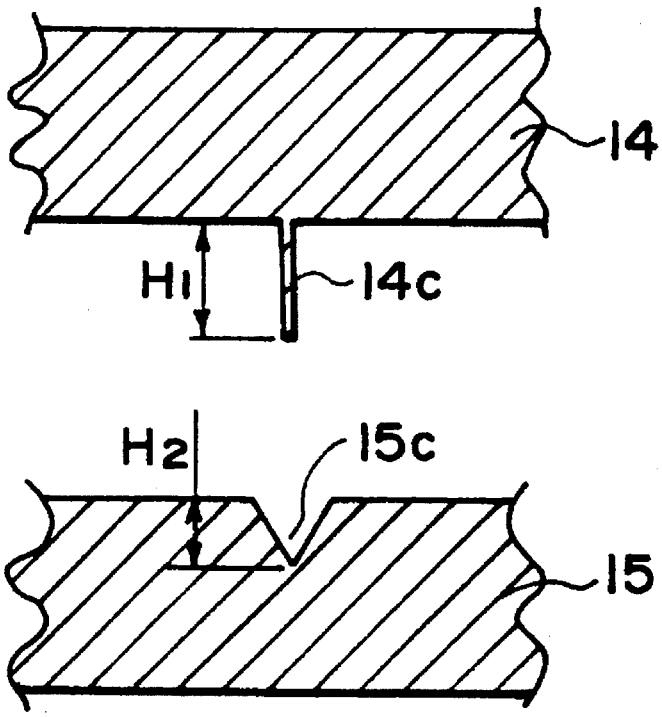
FIG. 10 includes FIGS. 10(*a*) and 10(*b*) and illustrates another embodiment in which the sealing portion is straight.
Figure 10B:
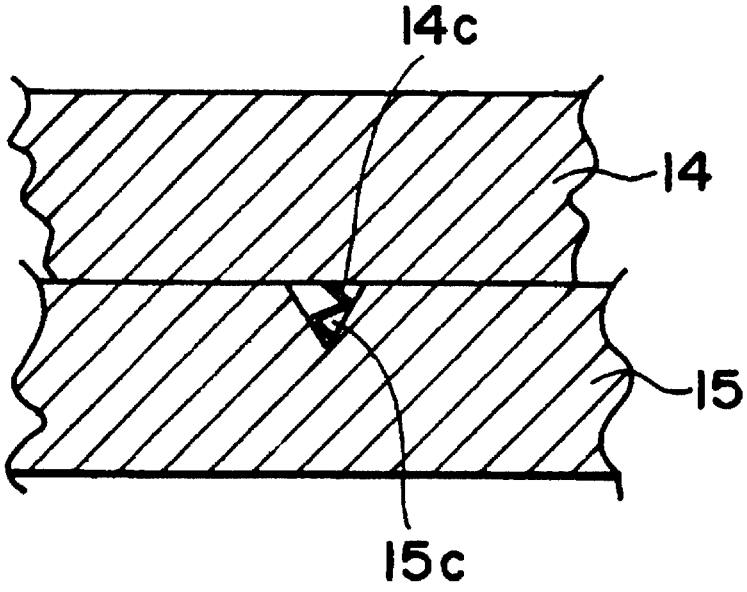

In the foregoing embodiment, the seal **14*b* is curved in cross-section, but it may be linear as shown in FIG. 10**, (*a*), by reference numeral **14*c*. In this case, it is desirable that a V-groove 15*c* is formed in the bottom frame 15 where it is coupled with top frame 14**.

Here, a height H1 of the seal **14*c* in the top frame 15 and a depth H2 of the V-groove 15*c* in the bottom frame 15, satisfy H1> H2. When the top and bottom frames 14 and 15 are coupled, the seal 14*c* are deformed as shown in FIG. 10**, (*b*), so that the seal is contacted at a plurality of portions in the V groove **15*c***, so that the sealing effect is assured. Where the seal formed by the two-color molding is linear, the manufacturing of the molds is easier.

In the foregoing embodiments, the frame and the seals are of different synthetic resin materials, but the same materials may be used. In this case, the colors of the frame and the seal are the same.

Figure 13:
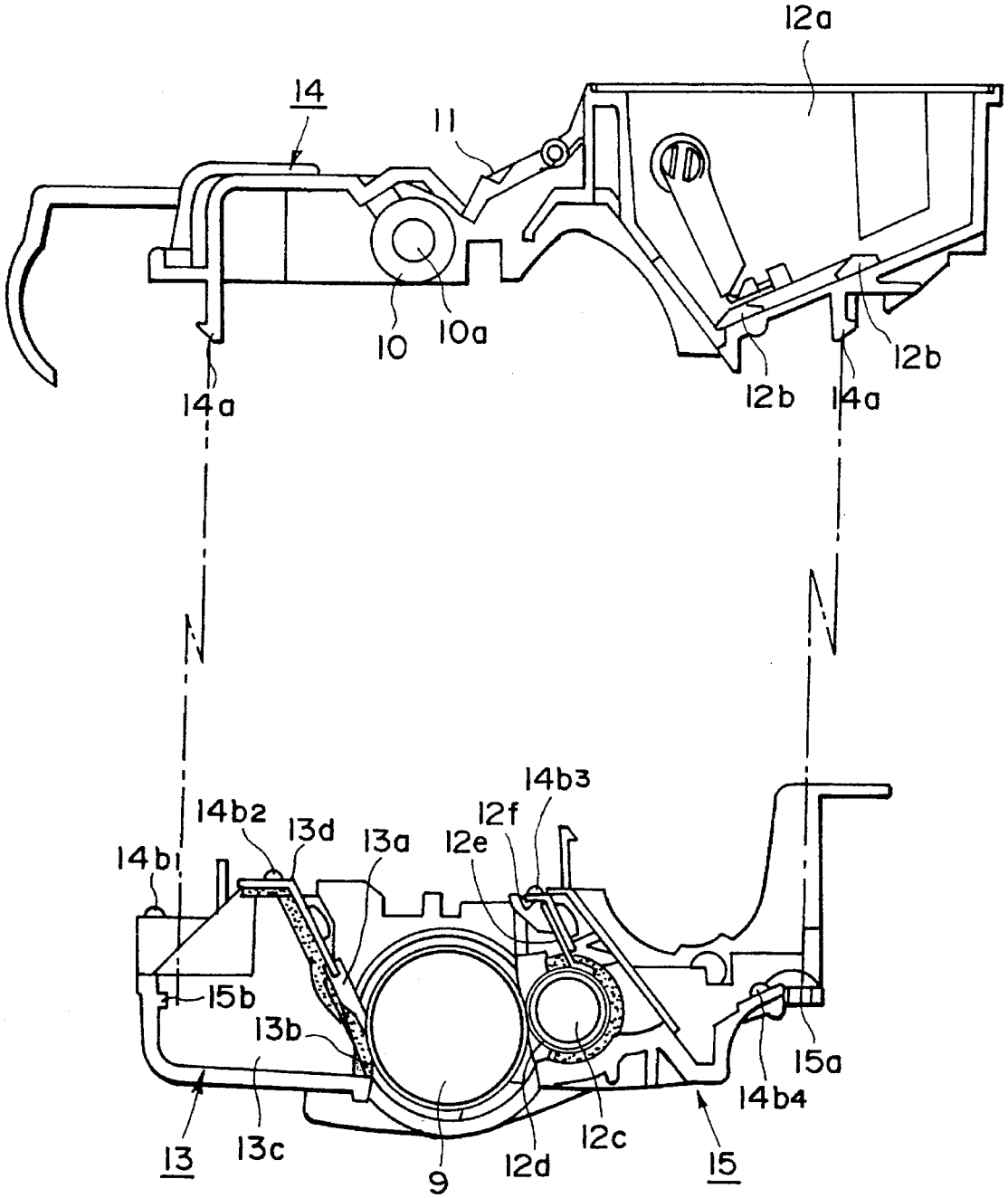
FIG. 13 is a side view of another example in which the sealing portion is integrally molded with the bottom frame.

In the foregoing embodiments, the elastic seal **14*b* is integrally molded on the top frame 14 having the mounting portion for mounting the charging roller as the process means. However, as shown in FIG. 13, the elastic seal may be integrally formed with the bottom frame 15. Namely, in place of integral molding of the seal on the top frame 14, the elastic seals 14*b* (14*b*1– 14*b*4**) may be integrally formed on the bottom frame having the mounting portion for the electrophotographic photosensitive member and the mounting portions for the cleaning means and the developing means as the process means.

Another Embodiment

In the foregoing embodiments, the description has been made as to the sealing structure for the residual toner container in the cleaning means, but the sealing structure is not limited so that for the cleaning means. For example, it can be similarly applicable to the toner container **12*a* of the developing means 12. More particularly, the seal 12*b* in FIG. 2 is integrally formed with the top frame 14** through two-color molding. The process cartridge B according to this invention is not limited to a monochromatic image formation as described hereinbefore, but is suitably applicable to cartridges for multi-color image formation (two colors, three colors or full-color image formation, for example), having a plurality of developing means.

As for the developing method, any known methods such as a two-component magnetic brush method, cascading method, touch-down method, cloud developing method or the like, are usable.

In the first embodiment, the charging means is a so-called contact charging device. Another charging means is usable, an example of which is a tungsten wire shielded by metal plates such as aluminum plate at three sides thereof, with a high voltage applied to the tungsten wire. In this case, the produced positive of negative ions are moved to the surface of the photosensitive drum to uniformly charge the surface thereof.

The contact charging means may be of a roller type as described, a blade type (charging blade), a pad type, block type, rod type, wire type or the like.

The cleaning device may be of a blade type as described, fur brush type, magnetic brush type or the like.

The process cartridge comprises an image bearing member such as an electrophotographic photosensitive member and at least one process means actable thereon. Therefore, the process cartridge may be in another form, for example it may contain the image bearing member and the charging member; the image bearing member and the developing means; the image bearing member and the cleaning means; or the image bearing member and two or more process means.

Therefore, the process cartridge in this invention integrally contains the electrophotographic photosensitive member and the charging means, the developing means or the cleaning means, the cartridge being detachably mountable to the main assembly of the image forming apparatus.

In the foregoing embodiments, the photosensitive drum 7 and the developing sleeve **10*c* are contained in a cartridge, but the present invention is applicable to the case in which the photosensitive drum 7 or the developing sleeve 10*c*** are not contained in the cartridge, but mounted directly in the main assembly.

In the foregoing, the image forming apparatus has been described as in the form of a laser beam printer, but the present invention is applicable to another image forming apparatus such as an electrophotographic copying machine, facsimile machine, or word processor or the like.

As described in the foregoing, a sealing portion having elasticity enough to seal against developer is integrally formed on at least one of members to be coupled to constitute a developer containing portion. Therefore, the conventional mounting or injecting steps for the sealing materials in the cartridge assembly, is not required, thus making the assembling steps simpler.

Additionally, when the process cartridge is recycled, there is no need to replace the sealing member, so that the disassembling and reassembling operations are eliminated.

When the sealing portion is formed through two-color molding or outsert molding, the configuration or material of the sealing portion can be freely selected to assure the sealing effect.

While the invention has been described with reference to the structures disclosed herein, it is not confined to the details set forth and this application is intended to cover such modifications or changes as may come within the purposes of the improvements or the scope of the following claims.

What is claimed is:

1. A frame for a process cartridge which is detachably mountable to an electrophotographic image forming apparatus and which comprises an electrophotographic photosensitive member and process means actable on the electrophotographic photosensitive member, said frame comprising:

a base member having a mounting portion for mounting the process means; and an elastic sealing member for preventing leakage of a developer from the process cartridge when the process cartridge is assembled, wherein said base member and said elastic sealing member are integrally molded.

2. A frame according to claim 1, wherein when said frame is coupled with another frame, said elastic sealing member is interposed between said two frames to prevent leakage of the developer between said two frames.

3. A frame according to claim 2, wherein said two frames constitute a developer accommodating portion for containing the developer when said two frames are coupled.

4. A frame according to claim 3, wherein said developer accommodating portion accommodates developer removed from the electrophotographic photosensitive member.

5. A frame according to claim 3, wherein said developer accommodating portion comprises a developing roller for supplying the developer to the electrophotographic photosensitive member, and accommodates the developer to be supplied to the electrophotographic photosensitive member.

6. A frame according to claim 1, 4 or 5, wherein said base member and said elastic sealing member are integrally molded by insert molding or outsert molding.

7. A frame according to claim 1, 4 or 5, wherein said base member and said elastic sealing member are integrally formed by injection molding in which a material for said elastic sealing member is injected so as to cover a projection integrally molded on said base member.

8. A process cartridge, which is detachably mountable to an electrophotographic image forming apparatus, said process cartridge comprising:

an electrophotographic photosensitive member; and process means actable on said electrophotographic photosensitive member; and a frame including:

a base member having a mounting portion for mounting said process means; and an elastic sealing member for preventing leakage of a developer from said process cartridge when said process cartridge is assembled, wherein said base member and said elastic sealing member are integrally molded.

9. A process cartridge according to claim 8, wherein when said frame is coupled with another frame, said elastic sealing member is interposed between said two frames to prevent leakage of the developer between said two frames.

10. A process cartridge according to claim 9, wherein said two frames constitute a developer accommodating portion for containing the developer when said two frames are coupled.

11. A process cartridge according to claim 10, wherein said developer accommodating portion accommodates the developer removed from said electrophotographic photosensitive member.

12. A process cartridge according to claim 10, wherein said developer accommodating portion comprises a developing roller for supplying the developer to said electrophotographic photosensitive member, and accommodates the developer to be supplied to said electrophotographic photosensitive member.

13. A process cartridge according to claim 8, 11 or 12, wherein said base member and said elastic sealing member are integrally molded by insert molding or outsert molding.

14. A process cartridge according to claim 8, 11 or 12, wherein said base member and said elastic sealing member are integrally formed by injection molding in which a material for said elastic sealing member is injected so as to cover a projection integrally molded on said base member.

15. A process cartridge according to claim 8, wherein said process cartridge contains said electrophotographic photosensitive member and charging means, developing means or cleaning means as said process means, as a unit which is detachably mountable to the electrophotographic image forming apparatus.

16. A process cartridge according to claim 8, wherein said process cartridge contains said electrophotographic photosensitive member and at least one of charging means, developing means and cleaning means as said process means, as a unit which is detachably mountable to the electrophotographic image forming apparatus.

17. A process cartridge according to claim 8, wherein said process cartridge contains at least said electrophotographic photosensitive member and developing means as said process means, as a unit which is detachably mountable to the electrophotographic image forming apparatus.

18. An electrophotographic image forming apparatus to which a process cartridge is detachably mountable, for forming an image on a recording material, said apparatus comprising:

mounting means for mounting a process cartridge, the process cartridge including an electrophotographic photosensitive member and process means actable on the electrophotographic photosensitive member; a frame including a base member having a mounting portion for mounting the process means; and an elastic sealing member for preventing leakage of a developer from said process cartridge when said process cartridge is assembled, wherein the base member and the elastic sealing member are integrally molded;

transfer means for transferring onto the recording material a toner image formed on the electrophotographic photosensitive member of the process cartridge mounted to said image forming apparatus;

fixing means for fixing the toner image on the recording material; and means for feeding the recording material.

19. An apparatus according to claim 18, wherein said apparatus is an electrophotographic copying machine.

20. An apparatus according to claim 18, wherein said apparatus is a laser beam printer.

21. A frame for a process cartridge which comprises an electrophotographic photosensitive member and process means actable on the electrophotographic photosensitive member, and which is detachably mountable to an image forming apparatus, the image forming apparatus comprising transfer means for transferring onto a recording material a toner image formed on the electrophotographic photosensitive member, fixing means for fixing the toner image on the recording material, and means for feeding the recording material, said frame comprising:

a base member having a first mounting portion for mounting the electrophotographic photosensitive member and a second mounting portion for mounting the process means; and an elastic sealing member for preventing leakage of a developer from the process cartridge when the process cartridge is assembled, wherein said base member and said elastic sealing member are integrally molded.

22. A frame according to claim 21, wherein when said frame is coupled with another frame, said elastic sealing member is interposed between said two frames to prevent leakage of the developer between said two frames.

23. A frame according to claim 22, wherein said two frames constitute a developer accommodating portion for containing the developer when said two frames are coupled.

24. A frame according to claim 23, wherein said developer accommodating portion accommodates the developer removed from the electrophotographic photosensitive member.

25. A frame according to claim 23, wherein said developer accommodating portion comprises a developing roller for supplying the developer to the electrophotographic photosensitive member, and accommodates the developer to be supplied to the electrophotographic photosensitive member.

26. A frame according to claim 21, 24 or 25, wherein said base member and said elastic sealing member are integrally molded by insert molding or outsert molding.

27. A frame according to claim 21, 24 or 25, wherein said base member and said elastic sealing member are integrally formed by injection molding in which a material for said elastic sealing member is injected so as to cover a projection integrally molded on said base member.

28. A process cartridge detachably mountable to an image forming apparatus, the image forming apparatus comprising transfer means for transferring onto a recording material a toner image formed on an electrophotographic photosensitive member, fixing means for fixing the toner image on the recording material, and means for feeding the recording material, said process cartridge comprising:

an electrophotographic photosensitive member;

process means actable on said electrophotographic photosensitive member; and a frame comprising:

a base member having a first mounting portion for mounting said electrophotographic photosensitive member and a second mounting portion for mounting said process means; and an elastic sealing member for preventing leakage of a developer from said process cartridge when said process cartridge is assembled, wherein said base member and said elastic sealing member are integrally molded.

29. A process cartridge according to claim 28, wherein when said frame is coupled with another frame, said elastic sealing member is interposed between said two frames to prevent leakage of the developer between said two frames.

30. A process cartridge according to claim 29, wherein said two frames constitute a developer accommodating portion for containing the developer when said two frames are coupled.

31. A process cartridge according to claim 30, wherein said developer accommodating portion accommodates the developer removed from said electrophotographic photosensitive member.

32. A process cartridge according to claim 30, wherein said developer accommodating portion comprises a developing roller for supplying the developer to said electrophotographic photosensitive member, and accommodates the developer to be supplied to said electrophotographic photosensitive member.

33. A process cartridge according to claim 28, 31 or 32, wherein said base member and said elastic sealing member are integrally molded by insert molding or outsert molding.

34. A process cartridge according to claim 28, 31 or 32, wherein said base member and said elastic sealing member are integrally formed by injection molding in which a material for said elastic sealing member is injected so as to cover a projection integrally molded on said base member.

35. A process cartridge according to claim 28, wherein said process cartridge contains said electrophotographic photosensitive member and charging means, developing means or cleaning means as said process means, as a unit which is detachably mountable to the image forming apparatus.

36. A process cartridge according to claim 28, wherein said process cartridge contains said electrophotographic photosensitive member and at least one of charging means, developing means and cleaning means as said process means, as a unit which is detachably mountable to the image forming apparatus.

37. A process cartridge according to claim 28, wherein said process cartridge contains at least said electrophotographic photosensitive member and developing means as said process means, as a unit which is detachably mountable to the image forming apparatus.

38. An electrophotographic image forming apparatus to which a process cartridge is detachably mountable, for forming an image on a recording material, said apparatus comprising:

mounting means for mounting a process cartridge, said process cartridge including an electrophotographic photosensitive member; process means actable on the electrophotographic photosensitive member, and a frame including a base member having a first mounting portion for mounting the electrophotographic photosensitive member and a second mounting portion for mounting the process means, and an elastic sealing member for preventing leakage of a developer from the process cartridge when the process cartridge is assembled, wherein the base member and the elastic sealing member are integrally molded;

transfer means for transferring onto a recording material a toner image formed on the electrophotographic photosensitive member of the process cartridge mounted to said image forming apparatus;

fixing means for fixing the toner image on the recording material; and means for feeding the recording material.

39. An apparatus according to claim 38, wherein said apparatus is an electrophotographic copying machine.

40. An apparatus according to claim 38, wherein said apparatus is a laser beam printer.

* * * * *

UNITED STATES PATENT AND TRADEMARK OFFICE

CERTIFICATE OF CORRECTION

PATENT NO. : 5,485,249

DATED : January 16, 1996

INVENTOR(S) : Akira HIGETA, et al.

It is certified that error appears in the above-indentified patent and that said Letters Patent is hereby corrected as shown below: On the title page, ITEM [30] - Foreign Application Priority Data:

"Aug. 26, 1994 [JP] Japan 5-201981" should read --Aug. 26, 1994 [JP] Japan 6-201981--.

COLUMN 3:

Line 6, "molding." should read --moldings--; and,
Line 8, "molding" should read --moldings--.

COLUMN 4:

Line 67, "to the fixing film 7e," should be deleted.

COLUMN 6:

Line 49, "12f" should read --12f is--.

UNITED STATES PATENT AND TRADEMARK OFFICE

CERTIFICATE OF CORRECTION

PATENT NO. : 5,485,249

DATED : January 16, 1996

INVENTOR(S) : Akira HIGETA, et al

It is certified that error appears in the above-indentified patent and that said Letters Patent is hereby corrected as shown below:

COLUMN 11:

Line 2, "against" should read --against a--.

Signed and Sealed this

Twenty-fifth Day of June, 1996

*Attest:*

Bruce Lehman

BRUCE LEHMAN

*Attesting Officer*

*Commissioner of Patents and Trademarks*